US008584756B1

(12) United States Patent
Barlow et al.

(10) Patent No.: US 8,584,756 B1
(45) Date of Patent: Nov. 19, 2013

(54) METHODS OF ISOLATING ANNULAR AREAS FORMED BY MULTIPLE CASING STRINGS IN A WELL

(71) Applicant: Halliburton Energy Services, Inc., Houston, TX (US)

(72) Inventors: Darren R. Barlow, Aberdeen (GB); Calvin W. Kessler, Houston, TX (US)

(73) Assignee: Halliburton Energy Sevices, Inc., Houston, TX (US)

( * ) Notice: Subject to any disclaimer, the term of this patent is extended or adjusted under 35 U.S.C. 154(b) by 0 days.

(21) Appl. No.: 13/740,516

(22) Filed: Jan. 14, 2013

(30) Foreign Application Priority Data

Jan. 17, 2012 (WO) ..... PCT/US2012/021550

(51) Int. Cl.
*E21B 33/14* (2006.01)

(52) U.S. Cl.
USPC ..... 166/285; 166/292; 166/297; 166/250.12

(58) Field of Classification Search
USPC ..... 166/292, 285, 297, 298, 250.12, 242.1, 166/177.4
See application file for complete search history.

(56) References Cited

U.S. PATENT DOCUMENTS

| | | | | | |
|---|---|---|---|---|---|
| 3,003,556 | A | * | 10/1961 | McGehee | 166/297 |
| 4,495,997 | A | | 1/1985 | Scott et al. | |
| 4,655,286 | A | | 4/1987 | Wood | |
| 5,467,824 | A | * | 11/1995 | DeMarsh et al. | 166/297 |
| 5,472,052 | A | * | 12/1995 | Head | 166/298 |
| 5,783,822 | A | | 7/1998 | Buchanan et al. | |
| 7,341,105 | B2 | * | 3/2008 | Bingamon et al. | 166/293 |
| 7,422,060 | B2 | * | 9/2008 | Hammami et al. | 166/281 |
| 7,665,537 | B2 | * | 2/2010 | Patel et al. | 166/387 |
| 7,908,034 | B2 | | 3/2011 | Gray | |
| 8,322,414 | B2 | * | 12/2012 | Al-Gouhi et al. | 166/250.12 |
| 2001/0015275 | A1 | * | 8/2001 | van Petegem et al. | 166/297 |
| 2006/0027366 | A1 | * | 2/2006 | Bour | 166/292 |
| 2007/0017675 | A1 | * | 1/2007 | Hammami et al. | 166/278 |
| 2010/0096134 | A1 | * | 4/2010 | Barlow et al. | 166/292 |
| 2010/0116504 | A1 | * | 5/2010 | Hoffman et al. | 166/336 |
| 2011/0120716 | A1 | | 5/2011 | Williams et al. | |

OTHER PUBLICATIONS

Search Report issued Oct. 4, 2012 for International Application U.S. Appl. No. PCT/US12/21550, 5 pages.
Written Opinion issued Oct. 4, 2012 for International Application U.S. Appl. No. PCT/US12/21550, 4 pages.
International Search Report with Written Opinion issued Oct. 4, 2012 for PCT Patent Application No. PCT/ U512/021550, 9 pages.

(Continued)

*Primary Examiner* — Nicole Coy
(74) *Attorney, Agent, or Firm* — Smith IP Services, P.C.

(57) ABSTRACT

A method of isolating annular areas formed by multiple well casings can include providing fluid communication through a wall of one of the casings at a location where another one of the casings outwardly surrounds the first casing, then flowing a cement into an annulus formed radially between the first and second casings, then providing fluid communication through the wall of the first casing and a wall of the second casing, and then flowing another cement into another annulus external to the second casing. A method of abandoning a well can include perforating a casing at a location where another casing outwardly surrounds the first casing, flowing a cement into an annulus formed radially between the first and second casings, the cement including a tracer, perforating the first and second casings, and flowing another cement into another annulus external to the second casing, the second cement including a second tracer.

36 Claims, 4 Drawing Sheets

(56) References Cited

OTHER PUBLICATIONS

Carbo Ceramics; "Non-Radioactive Traceable proppant", company article 1001_112, dated 2011, 2 pages.
Halliburton; "Maxim Shaped Charge", H04319, dated Jul. 2007, 2 pages.
Halliburton; "Pulsonix TF Service", H05026, dated Mar. 2011, 2 pages.
Halliburton; "Wireline & Perforating", H06064, dated Feb. 2009, 12 pages.
Hydrawell Intervention; "HydraWash", web page description, dated Jan. 18, 2011, 2 pages.
Offshore Technology Conference; "A Multiple Well Abandonment Program: Methodology and Techniques", OTC 7479, dated May 2-5, 1994, 12 pages.
Offshore Technology Conference; "Oriented Perforating as a Sand Prevention Measure—Case Studies from a Decade of Field Experience Validating the Method Offshore Norway", OTC 19130, dated May 5-8, 2008, 12 pages.
Momentive; "PropTrac: Fracture Diagnostics Service", Technical Data Sheet, HCD-3785, dated Nov. 16, 2011, 2 pages.
Society of Petroleum Engineers International; "Novel Approach to More Effective Plug and Abandonment of Cementing Techniques", SPE 148640, dated oCT. 18-20, 2011, 13 pages.
Gas Technology; "A Proven Gas-Well Completion Technique for Higher Deliverability", SPE1002, dated Mar. 15, 1965, 10 pages.
Society of Petroleum Engineers of AIME; "Maximum Differential Pressure Perforating", SPE 2648, dated Sep. 1-Oct. 1, 1969, 8 pages.

* cited by examiner

METHODS OF ISOLATING ANNULAR AREAS FORMED BY MULTIPLE CASING STRINGS IN A WELL

CROSS-REFERENCE TO RELATED APPLICATION

This application claims the benefit under 35 USC §119 of the filing date of International Application Serial No. PCT/US12/21550 filed 17 Jan. 2012. The entire disclosure of this prior application is incorporated herein by this reference.

BACKGROUND

This disclosure relates generally to equipment utilized and operations performed in conjunction with subterranean wells and, in one example described below, more particularly provides a method of isolating annular areas formed by multiple casing strings.

In the past, wells have been abandoned by milling through a casing to access an annulus behind the casing, and then placing cement in the milled-out area. Such a method is increasingly impractical if multiple casings and multiple annuli are involved. Therefore, it will be appreciated that improvements are needed in the art.

SUMMARY

In this disclosure, methods are provided which bring improvements to the art of isolating annular areas behind casings. One example is described below in which an innermost annulus is first isolated, and then an outer annulus is isolated by flowing cement radially through the inner annulus to the outer annulus. Another example is described below in which a well is abandoned by performing such a method.

A method of isolating annular areas formed by multiple well casings is provided to the art by the disclosure below. In one example, the method can include perforating a first one of the casings at a location where a second one of the casings outwardly surrounds the first casing, the perforating of the first casing being performed without perforating the second casing; flowing a first cement into a first annulus formed radially between the first and second casings; perforating the first and second casings; and flowing a second cement into a second annulus external to the second casing.

In another aspect, a method of abandoning a well is described below. The method, in one example, can include perforating a first casing at a location where a second casing outwardly surrounds the first casing; flowing a first cement into a first annulus formed radially between the first and second casings, the first cement including a first tracer; perforating the first and second casings; and flowing a second cement into a second annulus external to the second casing, the second cement including a second tracer.

In one example, the method can include providing fluid communication through a wall of a first one of the casings at a location where a second one of the casings outwardly surrounds the first casing; then flowing a first cement into a first annulus formed radially between the first and second casings; then providing fluid communication through the wall of the first casing and a wall of the second casing; and then flowing a second cement into a second annulus external to the second casing.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
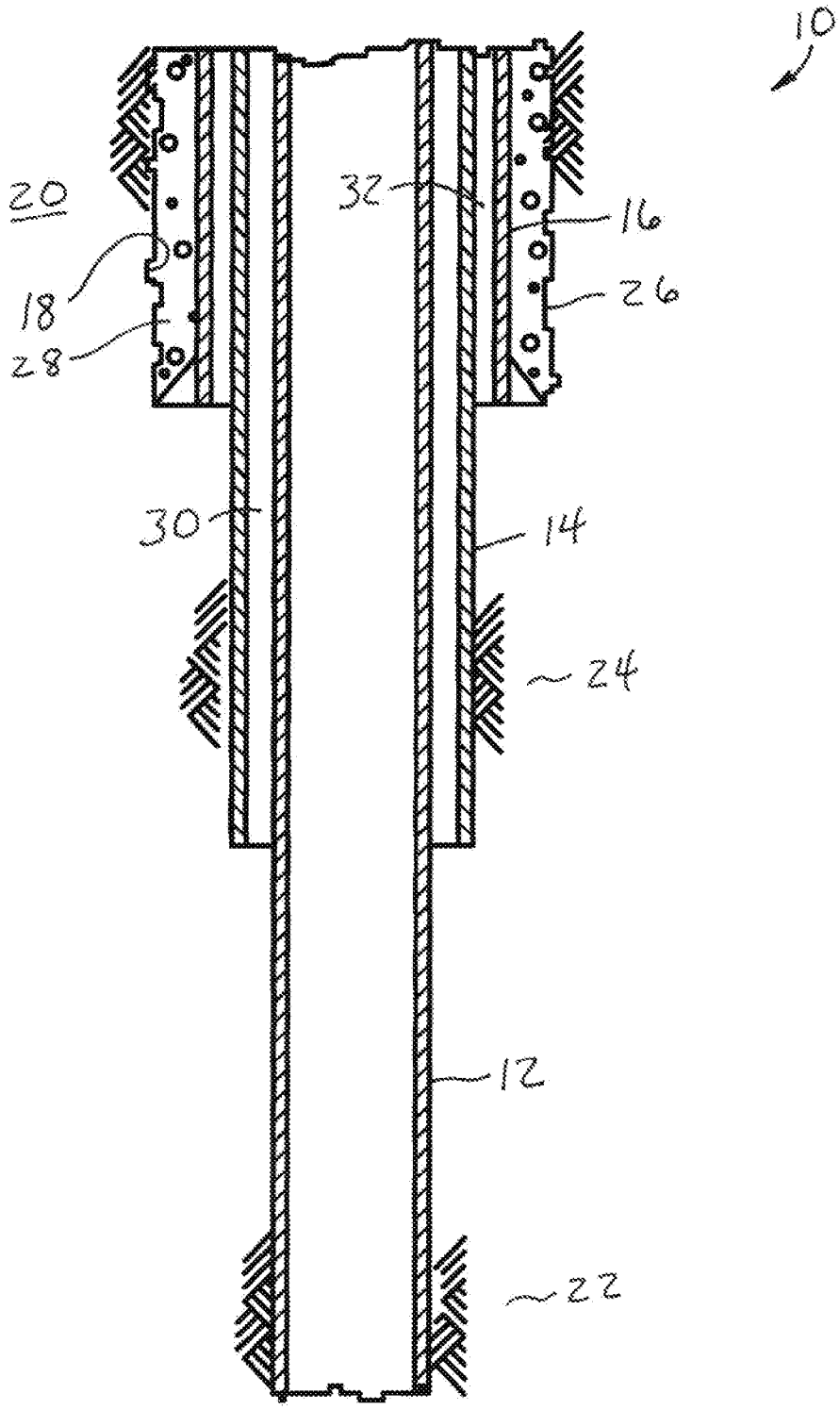
FIG. 1 is a representative cross-sectional view of a well system and associated method which can embody principles of this disclosure.

Representatively illustrated in FIG. 1 is a well system 10 and associated method which can embody principles of this disclosure. Note that the system 10 and method are merely one example of an application of the principles of this disclosure, and those principles are not limited to the particular details of the system and method described herein or depicted in the drawings.

In the FIG. 1 example, multiple casings 12, 14, 16 extend through a wellbore 18 drilled into a subterranean formation 20. A first one of the casings 12 penetrates a first zone 22, and a second one of the casings 14 penetrates a second zone 24 (the first casing 12 also extends through the zone 24).

In this example, the casing 12 may be used to produce fluid from and/or inject fluid into the zone 22, and the first and second casings 12, 14 may be used to produce fluid from and/or inject fluid into the zone 24. The outermost casing 16 is cemented in the wellbore 18.

As used herein, the term "casing" is used to indicate a protective lining for a wellbore, and encompasses tubulars known to those skilled in the art as casing, liner and tubing. Casing may be made of metals, non-metals, polymers and/or composite materials. Casing may be segmented or continuous. Casing may be pre-formed or formed in situ. Casing may have conductors, optical waveguides, hydraulic passages or other types of lines therein (e.g., in a wall of the casing, exterior or interior to the casing, etc.).

As used herein, the term "cement" is used to indicate a flowable substance which hardens in a well and thereby obstructs flow of fluid in the well. Cement can be cementitious (e.g., so that the cement hardens in response to being hydrated), but is not necessarily cementitious. Cements can include epoxies or other polymers. Cements can have additives and other substances included therein. In flowable form, a cement can comprise a slurry.

Cement can be used to seal and support a casing in a well. For example, in the system 10 of FIG. 1, cement 26 seals off an annulus 28 formed radially between the outer casing 16 and the wellbore 18.

If it is desired to seal off or isolate additional annuli 30, 32 (for example, in preparation for abandonment of the well), a method described more fully below allows this result to be accomplished conveniently and economically. One additional benefit of the method is that it does not require milling through any casing (although milling could be used, if desired).

Note that it is not necessary for the casing 16 to outwardly surround the casing 14, in keeping with the principles of this disclosure since, for example, the annulus 32 could be otherwise formed between the casing 14 and the wellbore 18. Although three casings 12, 14, 16 are depicted in FIGS. 1-4, any other number of casings may be used, while remaining within the scope of this disclosure.

In an initial step of the method, a logging run is performed, in order to establish a baseline against which subsequent measurements can be compared. For example, the logging run could be performed with a conventional gamma ray logging tool conveyed by wireline or coiled tubing. In this manner, features (such as the existing cement 26, etc.) can be referenced prior to performing the remaining steps of the method.

Figure 2:
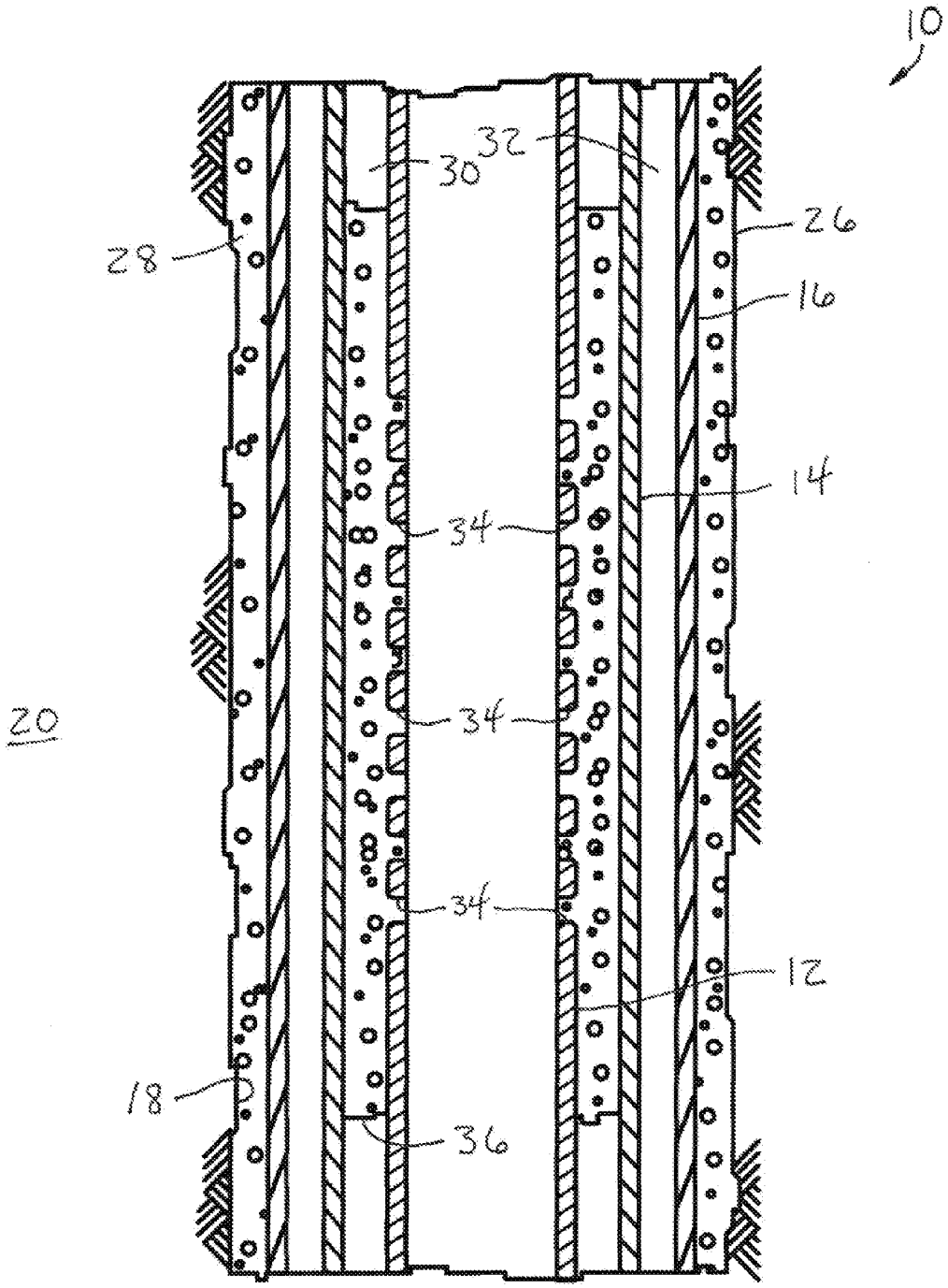
FIG. 2 is a representative cross-sectional view of the system and method, after an inner casing has been perforated, and cement has been flowed into an annulus external to the casing.

Referring additionally now to FIG. 2, an enlarged scale cross-sectional view of a section of the well system 10 is representatively illustrated. At a location depicted in the FIG. 2 example, the casing 14 outwardly surrounds the inner casing 12, and the outer casing 16 outwardly surrounds the casing 14.

The inner casing 12 is perforated, for example, by conveying a perforating gun through the inner casing and firing perforating charges of the gun to form perforations 34. Any other manner of forming the perforations 34 may be used, if desired (e.g., chemical cutting, drilling, etc.). If the inner casing 12 is perforated by a perforating gun, the perforating charges are preferably selected so that, when detonated, the charges will only perforate the inner casing, and will not perforate the next outer casing 14.

These types of perforating charges may be of the type known to those skilled in the art as "tubing puncher" charges or extremely shallow penetrating charges. The shallow penetrating can be accomplished by combinations of explosive quantity and type, and charge case and charge liner size and focusing shape.

Preferably, this operation is performed using a relatively large perforating gun that can be safely deployed. A large perforating gun provides surge volume (e.g., due to a length and diameter of a tubular gun carrier of the perforating gun) that is originally at or near atmospheric pressure. This surge volume can produce a dynamic underbalance effect that can draw debris through perforations and into the wellbore 18 and perforating gun when the perforations are formed and the gun carrier is pierced. Such perforation surging techniques are known to those skilled in the art.

As used herein, the terms "perforate," "perforation," "perforating," and similar terms are used to indicate the permitting of fluid communication via an opening through a wall of a casing. It is not essential for a perforation to be formed by a perforating gun since, as mentioned above, perforations (including other types of openings) could be formed by drilling, chemical cutting or other techniques.

The annulus 30 is now flushed of debris and contaminants. A washing/flushing tool (such as, a PULSONIX™ tool marketed by Halliburton Energy Services, Inc. of Houston, Tex. USA, a HYDRAWASH™ tool marketed by HydraWell Intervention of Norway, etc.) may be used to flush and clean the annulus 30 between the casings 12, 14. Another alternative is to use a vacuuming effect (e.g., due to a dynamic underbalance at time of perforating, using a Baker vacuum tool, etc.) to clean the perforations 34.

The washing/flushing tool(s) can be dropped off in the well, or retrieved back to the surface after the washing/flushing step.

Cement 36 is now flowed into the annulus 30 using, for example, a conventional cement squeeze tool. The cement 36 is allowed to harden or "set" in the annulus 30.

FIG. 2 depicts the system 10 after the cement 36 has hardened in the annulus 30. Any cement left in the interior of the casing 12 can then be drilled through in preparation for the next step.

Figure 3:
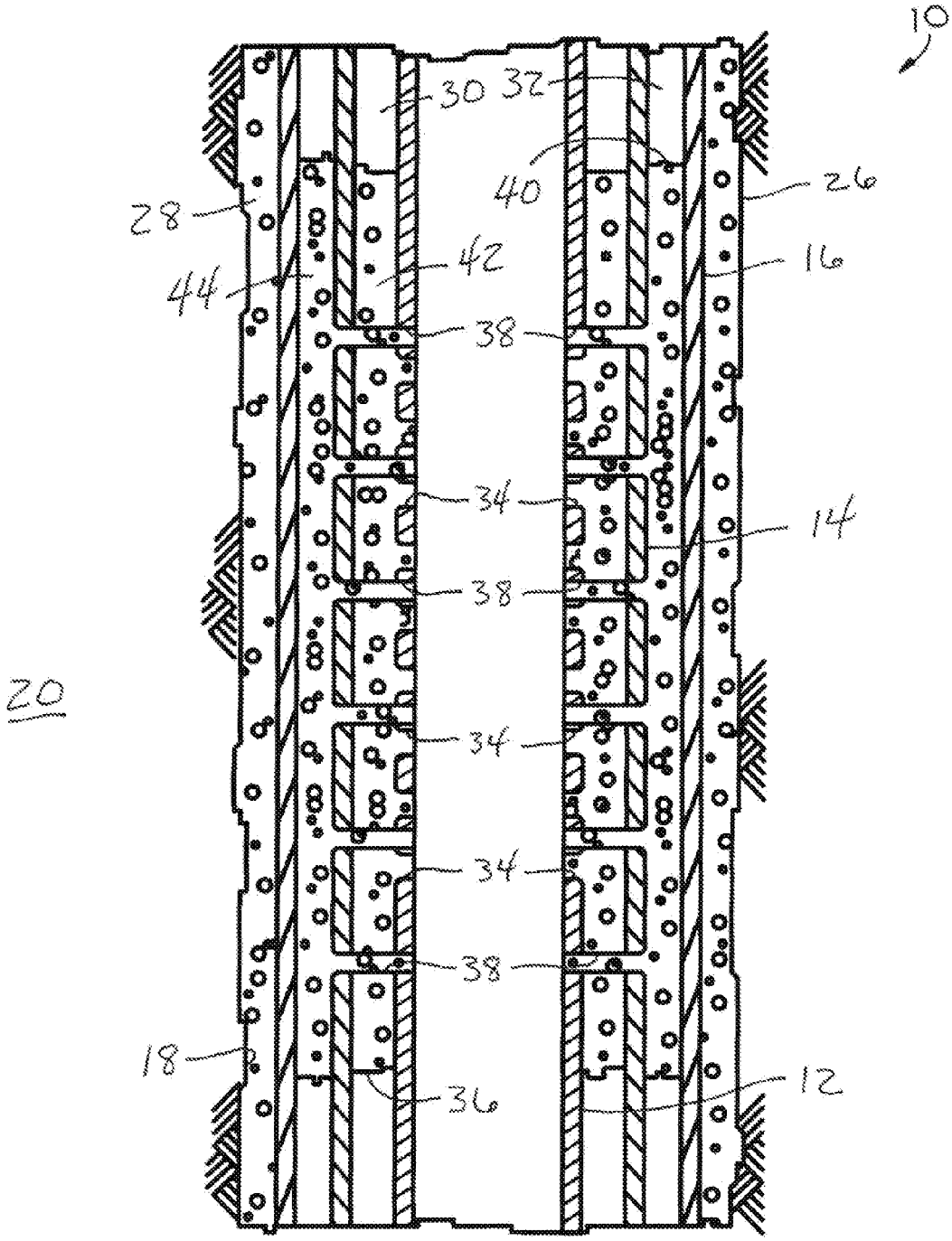
FIG. 3 is a representative cross-sectional view of the system and method, after another casing has been perforated, and cement has been flowed into another annulus external to the casing.

Referring additionally now to FIG. 3, the casings 12, 14 are perforated, for example, by conveying a perforating gun through the inner casing and firing perforating charges of the gun to form perforations 38 through both of the casings 12, 14.

Any other manner of forming the perforations 38 may be used, if desired. If the casings 12, 14 are perforated by a perforating gun, a suitable charge for penetrating both of the casings is a MAXIM™ perforating charge marketed by Halliburton Energy Services, Inc.

In the example depicted in FIG. 3, a longitudinal spacing of the perforations 38 is greater than a longitudinal spacing of the perforations 34. However, in other examples these spacings could be equivalent or reversed (e.g., the spacing of the perforations 34 could be greater than the spacing of the perforations 38). In addition, an azimuthal spacing between perforations can be different, or the same, for the perforations 34, 38.

The perforating gun can be dropped off in the well, or retrieved to the surface, after the perforating step.

The annulus 32 is now flushed of debris and contaminants. A washing/flushing tool (such as, the PULSONIX™ tool, the HYDRAWASH™ tool, the Baker vacuum tool, and/or a dynamic underbalance, as mentioned above) may be used to flush and clean the annulus 32 between the casings 14, 16. Note that the prior isolation of the annulus 30 by the cement 36 facilitates this flushing step.

Cement 40 is now flowed into the annulus 32 using, for example, a conventional cement squeeze tool. Again, note that the prior isolation of the annulus 30 by the cement 36 also facilitates the efficient flowing of the cement 40 into the annulus 32 through the perforations 38.

The cement 40 is allowed to harden or "set" in the annulus 32. FIG. 3 depicts the system 10 after the cement 40 has hardened in the annulus 32.

Although the cement 40 is illustrated in FIG. 3 with substantially the same longitudinal extent as the cement 36, it will be appreciated that the "top" of the cement 40 could be above, below or at the same level as the "top" of the cement 36. Similarly, the "bottom" of the cement 40 could be above, below or at the same level as the "bottom" of the cement 36. In one example, the levels of the tops and bottoms of the cements 36, 40 are different, so that the cements can be more readily distinguished in the logging steps.

Note that, in the FIG. 3 example, each of the annuli 30, 32 has been sealed off by the respective cement 36, 40. To verify this desired result, a tracer 42, 44 can be added to the respective cement 36, 40. Although the cements 36, 40 may otherwise be of the same or similar composition, in an example of a verification technique described below, the tracers 42, 44 are preferably different, so that they can be independently identified downhole.

The tracers 42, 44 (or either of them) may comprise a radioactive material. Preferred radioactive materials include materials having half lives of less than ninety days, and which are detectable with conventional gamma ray logging tools or spectral gamma measurements. Suitable radioactive materials include Antimony (e.g., Sb124), Iridium (e.g., Ir192) and Scandium (e.g., Sc46). Other radioactive materials may be used, if desired.

However, it is not necessary for the tracers 42, 44 to comprise a radioactive material. For example, suitable non-radioactive tracer materials are described in U.S. Pat. No. 5,783,822, the entire disclosure of which is incorporated herein by this reference.

The tracers 42, 44 (or either of them) may comprise a chemical tracer. Some chemical tracers become radioactive when "activated" by logging tools that utilize a neutron generator and measurements of decay of high energy neutron bursts, or by logging tools that have sealed chemical sources, such as AmBe, Cesium or other radioactive sources. Preferred chemical tracers include those with long term detectability.

Suitable chemical tracers include PROP TRAC™ marketed by Momentive Specialty Chemicals Inc. of Houston, Tex. USA, and CARBONRT™ marketed by CARBO Ceramics Inc. of Houston, Tex. USA. The PROP TRAC™ material is detectable by a conventional 2⅛ inch Reservoir Monitoring logging tool, and the CARBONRT™ material is detectable by a conventional 2¾ inch Hostile Dual Space Neutron logging tool with a chemical neutron source of sufficient flux (or strength). Other chemical tracer materials and other logging tools may be used, if desired.

A suitable logging tool can be conveyed through the inner casing 12 after the cement 36 has been placed in the annulus 30 and/or after the cement 40 has been placed in the annulus 32. In this manner, the extents of the cements 36, 40 (by measurement of the extents of the respective tracers 42, 44 by the logging tool) in the respective annuli 30, 32 can be independently verified to ensure that the annuli have been adequately isolated. If one or both of the annuli 30, 32 has not been adequately isolated, remedial action can be taken.

In one technique, the logging can be performed after the cement 36 has been placed in the annulus 30, and again after the cement 40 has been placed in the annulus 32. In this manner, the cement 40 can be more readily distinguished from the cement 36 (e.g., by comparing results of the two logging runs).

Figure 4:
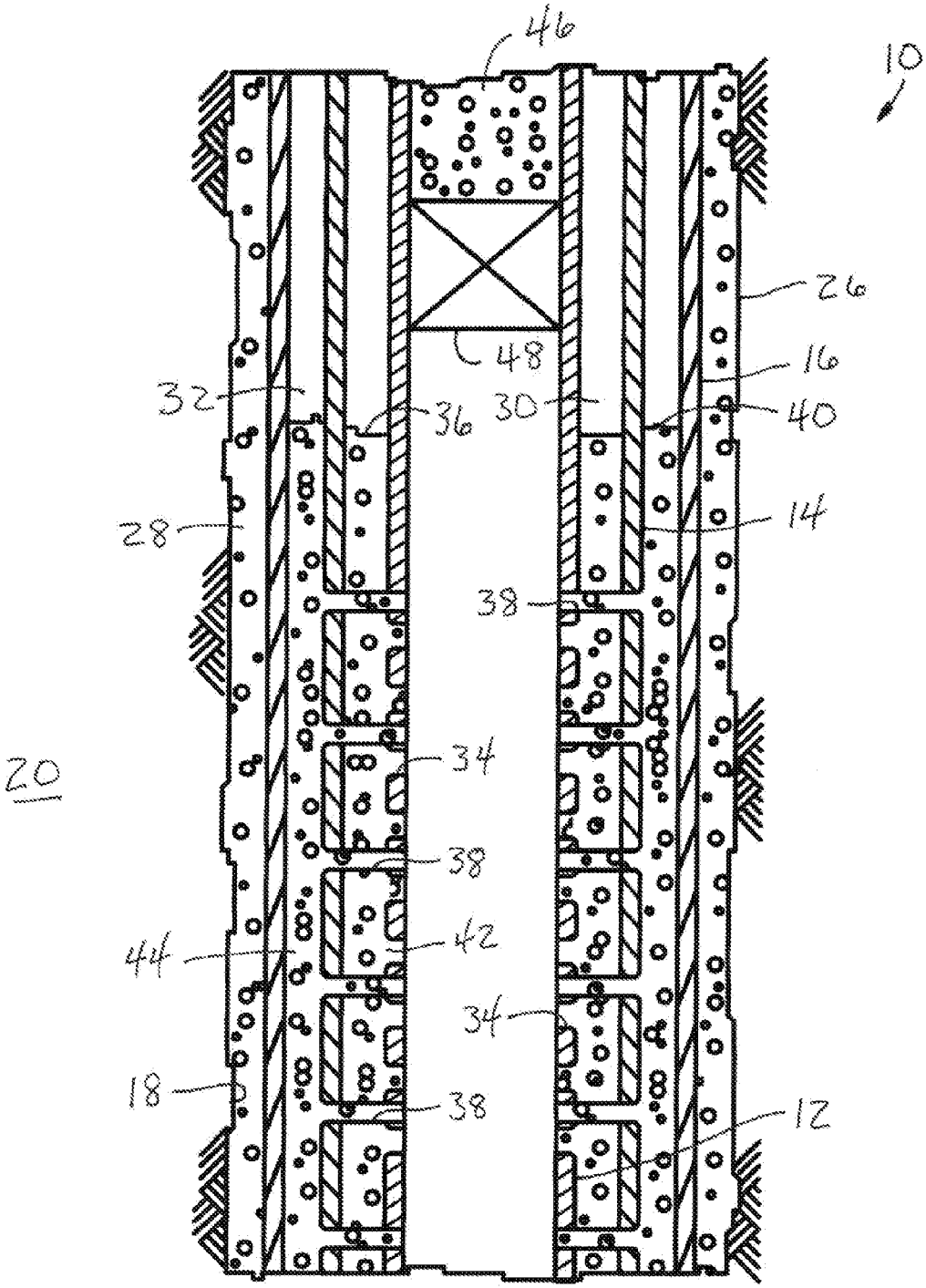
FIG. 4 is a representative cross-sectional view of the system and method, in which a well has been abandoned.

Referring additionally now to FIG. 4, the system 40 is depicted in a well abandonment method. Note that a bridge plug 48 has been set in the casing 12, and cement 46 has been placed above the bridge plug. With the annuli 28, 30, 32 isolated by the respective cements 26, 36, 40, and the bridge plug 48 and cement 46 sealing off the interior of the casing 12, the well is adequately secured against inadvertent escape of fluids from the well.

Note that it is not necessary for either or both of the cements 36, 40 to include the respective tracers 42, 44. In one example, only the cement 40 may have the tracer 44 therein since, being positioned farther from the inner casing 12, it may be more difficult to verify the presence and extent of that cement.

It can now be fully appreciated that this disclosure provides significant advancements to the art. In one example, the disclosure describes a method of isolating annular areas formed by multiple well casings 12, 14, 16. Any number of casings and annular areas may be used, in keeping with the scope of this disclosure.

The method can include providing fluid communication through a wall of a first one of the casings 12 at a location where a second one of the casings 14 outwardly surrounds the first casing 12; then flowing a first cement 36 into a first annulus 30 formed radially between the first and second casings 12, 14; then providing fluid communication through the wall of the first casing 12 and a wall of the second casing 14; and then flowing a second cement 40 into a second annulus 32 external to the second casing 14.

Longitudinal extents of the first and second cements 36, 40 in the respective first and second annuli 30, 32 may be the same, or they may be different.

This disclosure also provides to the art a method which, in one example, can include perforating a first one of the casings 12 at a location where a second one of the casings 14 outwardly surrounds the first casing 12, the perforating of the first casing 12 being performed without perforating the second casing 14; flowing a first cement 36 into a first annulus 30 formed radially between the first and second casings 12, 14; perforating the first and second casings 12, 14; and flowing a second cement 40 into a second annulus 32 external to the second casing 14.

Flowing the first cement 36 can include flowing the first cement 36 with a first tracer 42.

The method can include allowing the first cement 36 to harden, and then detecting an extent of the first tracer 42 in the first annulus 30.

The first tracer 42 can comprise a radioactive tracer, a non-radioactive tracer and/or a chemical tracer.

Flowing the second cement 40 can include flowing the second cement 40 with a tracer 44.

The method can include allowing the second cement 40 to harden, and then detecting an extent of the tracer 42 in the second annulus 32.

Flowing the first cement 36 can be performed after perforating the first casing 12. Perforating the first and second casings 12, 14 can be performed after flowing the first cement 36. Flowing the second cement 40 can be performed after perforating the first and second casings 12, 14.

A spacing of first perforations 34 produced by perforating the first casing 12 may be less than a spacing of second perforations 38 produced by perforating the first and second casings 12, 14.

The method can comprise flushing the first annulus 30 after perforating the first casing 12. The method can also comprise flushing the second annulus 32 after perforating the first and second casings 12, 14.

Also described above is a method of abandoning a well. In one example, the method can include perforating a first casing 12 at a location where a second casing 14 outwardly surrounds the first casing 12; flowing a first cement 36 into a first annulus 30 formed radially between the first and second casings 12, 14, the first cement 36 including a first tracer 42; perforating the first and second casings 12, 14; and flowing a second cement 40 into a second annulus 32 external to the second casing 14, the second cement 40 including a second tracer 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of isolating annular areas formed by multiple well casings, the method comprising:

providing fluid communication through a wall of a first one of the casings at a location where a second one of the casings outwardly surrounds the first casing;

then flowing a first cement into a first annulus formed radially between the first and second casings;

then providing fluid communication through the wall of the first casing, the first cement, and a wall of the second casing; and then flowing a second cement into a second annulus external to the second casing.

2. The method of claim 1, wherein providing fluid communication through the wall of the first casing is performed by perforating the first casing.

3. The method of claim 2, wherein the perforating of the first casing is performed without perforating the second casing.

4. The method of claim 1, wherein flowing the first cement further comprises including with the first cement a first tracer.

5. The method of claim 4, further comprising allowing the first cement to harden, and then detecting an extent of the first tracer in the first annulus.

6. The method of claim 4, wherein the first tracer comprises at least one of the group comprising a radioactive tracer, a non-radioactive tracer and a chemical tracer.

7. The method of claim 4, wherein flowing the second cement further comprises including with the second cement a second tracer.

8. The method of claim 7, further comprising allowing the second cement to harden, and then detecting an extent of the second tracer in the second annulus.

9. The method of claim 1, wherein flowing the second cement further comprises including with the second cement a tracer.

10. The method of claim 1, wherein longitudinal extents of the first and second cements in the respective first and second annuli are different.

11. A method of isolating annular areas formed by multiple well casings, the method comprising:

perforating a first one of the casings at a location where a second one of the casings outwardly surrounds the first casing, the perforating of the first casing being performed without perforating the second casing;

flowing a first cement into a first annulus formed radially between the first and second casings;

perforating the first casing, the first cement, and the second casing; and flowing a second cement into a second annulus external to the second casing.

12. The method of claim 11, wherein flowing the first cement further comprises including with the first cement a first tracer.

13. The method of claim 12, further comprising allowing the first cement to harden, and then detecting an extent of the first tracer in the first annulus.

14. The method of claim 12, wherein the first tracer comprises at least one of the group comprising a radioactive tracer, a non-radioactive tracer and a chemical tracer.

15. The method of claim 12, wherein flowing the second cement further comprises including with the second cement a second tracer.

16. The method of claim 15, further comprising allowing the second cement to harden, and then detecting an extent of the second tracer in the second annulus.

17. The method of claim 11, wherein flowing the first cement is performed after perforating the first casing.

18. The method of claim 11, wherein perforating the first and second casings is performed after flowing the first cement.

19. The method of claim 11, wherein flowing the second cement is performed after perforating the first and second casings.

20. The method of claim 11, wherein a spacing of first perforations produced by perforating the first casing is less than a spacing of second perforations produced by perforating the first and second casings.

21. The method of claim 11, further comprising flushing the first annulus after perforating the first casing.

22. The method of claim 21, further comprising flushing the second annulus after perforating the first and second casings.

23. The method of claim 11, wherein flowing the second cement further comprises including with the second cement a tracer.

24. A method of abandoning a well, the method comprising:

perforating a first casing at a location where a second casing outwardly surrounds the first casing;

flowing a first cement into a first annulus formed radially between the first and second casings, the first cement including a first tracer;

perforating the first casing, the first cement, and the second casing; and flowing a second cement into a second annulus external to the second casing, the second cement including a second tracer.

25. The method of claim 24, wherein the perforating of the first casing is performed without perforating the second casing.

26. The method of claim 24, further comprising allowing the first cement to harden, and then detecting an extent of the first tracer in the first annulus.

27. The method of claim 24, wherein the first tracer comprises at least one of the group comprising a radioactive tracer, a non-radioactive tracer and a chemical tracer.

28. The method of claim 24, further comprising allowing the second cement to harden, and then detecting an extent of the second tracer in the second annulus.

29. The method of claim 24, wherein flowing the first cement is performed after perforating the first casing.

30. The method of claim 24, wherein perforating the first and second casings is performed after flowing the first cement.

31. The method of claim 24, wherein flowing the second cement is performed after perforating the first and second casings.

32. The method of claim 24, wherein a spacing of first perforations produced by perforating the first casing is less than a spacing of second perforations produced by perforating the first and second casings.

33. The method of claim 24, further comprising flushing the first annulus after perforating the first casing.

34. The method of claim 33, further comprising flushing the second annulus after perforating the first and second casings.

35. The method of claim 24, wherein flowing the second cement further comprises including with the second cement a tracer.

36. The method of claim 24, wherein the second tracer is different from the first tracer.

* * * * *

UNITED STATES PATENT AND TRADEMARK OFFICE

CERTIFICATE OF CORRECTION

PATENT NO. : 8,584,756 B1
APPLICATION NO. : 13/740516
DATED : November 19, 2013
INVENTOR(S) : Darren R. Barlow and Calvin W. Kessler It is certified that error appears in the above-identified patent and that said Letters Patent is hereby corrected as shown below:

Title page, Item 73, Assignee:, cancel "Sevices" and insert in place thereof -- Services --.

Signed and Sealed this
Eighteenth Day of March, 2014

Michelle K. Lee

Michelle K. Lee
*Deputy Director of the United States Patent and Trademark Office*